US011060366B2

(12) United States Patent
Hall et al.

(10) Patent No.: US 11,060,366 B2
(45) Date of Patent: Jul. 13, 2021

(54) HIGH PRESSURE TEST PUMP SYSTEM FOR OFFSHORE CEMENTING SKID

(71) Applicant: HALLIBURTON ENERGY SERVICES, INC., Houston, TX (US)

(72) Inventors: Randall Turner Hall, Marlow, OK (US); Chip L. Imel, Edmond, OK (US); Gary Lee Cline, Duncan, OK (US); Craig A Sneed, Duncan, OK (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 288 days.

(21) Appl. No.: 15/745,887

(22) PCT Filed: Sep. 2, 2015

(86) PCT No.: PCT/US2015/048181

§ 371 (c)(1),
(2) Date: Jan. 18, 2018

(87) PCT Pub. No.: WO2017/039659

PCT Pub. Date: Mar. 9, 2017

(65) Prior Publication Data

US 2018/0209228 A1 Jul. 26, 2018

(51) Int. Cl.
*E21B 21/08* (2006.01)
*E21B 34/08* (2006.01)
(Continued)

(52) U.S. Cl.
CPC ..... *E21B 21/08* (2013.01); *E21B 33/06* (2013.01); *E21B 33/13* (2013.01); *E21B 34/08* (2013.01); *E21B 47/06* (2013.01)

(58) Field of Classification Search
CPC ..... E21B 21/08; E21B 33/06; E21B 33/13; E21B 34/08; E21B 47/06
See application file for complete search history.

(56) References Cited

U.S. PATENT DOCUMENTS 8,322,425 B2 * 12/2012 Smith ..... E21B 43/162 166/306
2009/0044951 A1 * 2/2009 Milkovisch ..... E21B 49/10 166/369

(Continued)

OTHER PUBLICATIONS

International Search Report and Written Opinion; PCT Application No. PCT/US2015/048181; dated May 12, 2016.

*Primary Examiner* — Caroline N Butcher
(74) *Attorney, Agent, or Firm* — Polsinelli PC

(57) ABSTRACT

A high pressure fluid pump system of a fluid injection system includes a large volume displacement system, having a large volume pump, and low volume displacement system, having a low volume pump, a programmable logic control (PLC) computer coupled with each displacement system. The large volume displacement system is configured to incrementally or continuously increase a pressure of a fluid in a downhole to a predetermined pressure setting below a maximum pressure setting, and the low volume displacement system is configured to increase the pressure of the fluid from the predetermined pressure setting to a pressure setting above the predetermined pressure setting and at or below the maximum pressure setting. The functioning of the high pressure fluid pump system can be monitored, controlled and tested by the PLC computer. One or more graphical user interfaces can be coupled to the PLC computer for user input.

25 Claims, 8 Drawing Sheets

(51) Int. Cl.

| | |
|---|---|
| ***E21B 47/06*** | (2012.01) |
| ***E21B 33/13*** | (2006.01) |
| ***E21B 33/06*** | (2006.01) |

(56) References Cited

U.S. PATENT DOCUMENTS

| | | | | |
|---|---|---|---|---|
| 2009/0151956 | A1 | 6/2009 | Johansen et al. | |
| 2009/0194273 | A1* | 8/2009 | Surjaatmadja | E21B 43/26 166/250.1 |
| 2011/0011593 | A1 | 1/2011 | Borhaug et al. | |
| 2011/0284226 | A1 | 11/2011 | Smith | |
| 2014/0124211 | A1* | 5/2014 | Warnock, Jr. | E21B 33/0355 166/363 |

* cited by examiner

HIGH PRESSURE TEST PUMP SYSTEM FOR OFFSHORE CEMENTING SKID

CROSS-REFERENCE TO RELATED APPLICATIONS

This application is a national stage entry of PCT/US2015/048181 filed Sep. 2, 2015, said application is expressly incorporated herein in its entirety.

FIELD

The present disclosure relates to regulating pressure within a wellbore of an oil or gas producing well. More particularly, the present disclosure relates to a pressure regulation apparatus, system, and method for regulating the pressure of a fluid composition to be introduced into a wellbore of an oil or gas producing well.

BACKGROUND

To liberate hydrocarbons, such as oil or gas, from a subterranean formation, wellbores can be drilled that penetrate hydrocarbon-containing portions of the subterranean formation. The portion of the subterranean formation from which hydrocarbons may be produced is commonly referred to as a "production zone." In some instances, a subterranean formation penetrated by the wellbore may have multiple production zones at various locations along the wellbore.

Generally, after a wellbore has been drilled to a desired depth, completion operations are performed. Such completion operations can include cementing at least a portion of the wellbore. The introduction of a fluid composition into a wellbore can be accomplished using a skid-mounted fluid injection system having, among other components, a high pressure pump which is used to pressurize and send the fluid composition downhole into the wellbore via a rig line. To raise the pressure of fluid composition in the wellbore, the pump rate of the high pressure pump is typically raised incrementally or "bumped" to reach a pressure as near as possible, but not above, an allowable maximum pressure rating of the system.

Such high pressure pumps generally allow for only coarse flow rate and pressure adjustments which can lead to over-pressurization of the fluid injection system and can result in degradation and/or reduced the working life of the pump. Over-pressurization can require recertification of components of the fluid injection system and result in potentially dangerous working conditions in and/or around the fluid injection system. Devices such as relief valves have been used to prevent over-pressurization of the high pressure pumps and other components of a fluid injection system. However, such relief valves do not change the coarse nature of flow rate and pressure increases applied to the high pressure pump and are therefore only meant to be used to prevent the pressure from exceeding the allowable maximum pressure rating of the system or a different rating set by the user. Furthermore, if over-pressurization occurs and the relief valve is actuated, recertification of components of the fluid injection system should be performed.

BRIEF DESCRIPTION OF THE DRAWINGS

Implementations of the present technology will now be described, by way of example only, with reference to the attached figures, wherein.

Figure 1A:
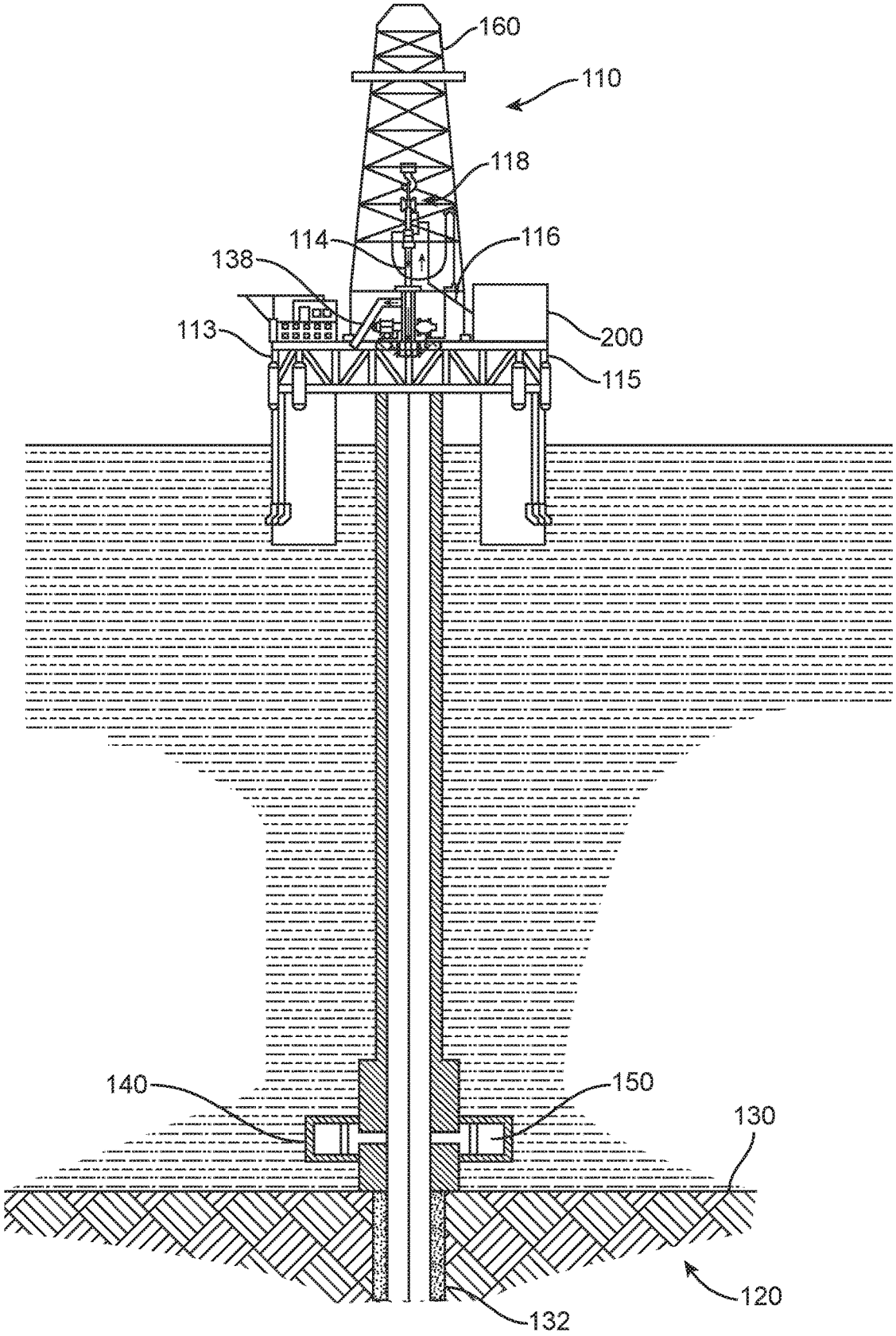
FIG. 1A is an overview diagram of the equipment for use in placement of a fluid composition in a wellbore in accordance with an exemplary embodiment.

It should be understood that the various aspects are not limited to the arrangements and instrumentality shown in the drawings.

DETAILED DESCRIPTION

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

In the following description, terms such as "upper," "upward," "lower," "downward," "above," "below," "downhole," "longitudinal," "lateral," and the like, as used herein, shall mean in relation to the bottom or furthest extent of, the surrounding wellbore even though the wellbore or portions of it may be deviated or horizontal. Correspondingly, the transverse, axial, lateral, longitudinal, radial, etc., orientations shall mean orientations relative to the orientation of the wellbore or apparatus. Additionally, the illustrated embodiments are illustrated such that the orientation is such that the right-hand side or bottom of the page is downhole compared to the left-hand side, and the top of the page is toward the surface, and the lower side of the page is downhole. Furthermore, the term "proximal" refers directionally to portions further toward the surface in relation to the term "distal" which refers directionally to portions further downhole and away from the surface in a wellbore.

Several definitions that apply throughout this disclosure will now be presented. The term "coupled" is defined as connected, whether directly or indirectly through intervening components, and is not necessarily limited to physical connections. The term "communicatively coupled" is defined as connected, either directly or indirectly through intervening components, and the connections are not necessarily limited to physical connections, but are connections that accommodate the transfer of data between the so-described components. The connections can be such that the objects are permanently connected or releasably connected. The term "outside" refers to a region that is beyond the outermost confines of a physical object. The term "axially" means substantially along a direction of the axis of the object. If not specified, the term axially is such that it refers to the longer axis of the object. The terms "comprising," "including" and "having" are used interchangeably in this disclosure. The terms "comprising," "including" and "having" mean to include, but are not necessarily limited to, the things so described. A "processor" as used herein is an electronic circuit that can make determinations based upon inputs. A processor can include a microprocessor, a microcontroller, and/or a central processing unit, among others. While a single processor can be used, the present disclosure can be implemented using a plurality of processors.

An example technique and system for placing a fluid composition into a subterranean formation will now be described with reference to FIGS. 1A and 1B. FIG. 1A illustrates an off-shore oil or gas rig 110 that can be used in placement of a fluid composition downhole in a wellbore in accordance with an exemplary embodiment. It should be noted that, while FIG. 1A generally depicts a sea-based operation, those skilled in the art will readily recognize that the principles described herein are equally applicable to land-based operations without departing from the scope of the disclosure. As shown, the off-shore oil or gas rig 110 can include a semi-submersible platform 113, centered over a submerged oil and gas formation (not shown) located below the sea floor 130, and a deck 115. A subsea conduit 118 extends from the deck 115 of the platform 113 to a wellhead installation 140, including one or more blowout preventers 150. The platform 113 can include a hoisting apparatus (not shown) and a derrick 160 for raising and lowering pipe strings. The off-shore oil or gas rig 110 can include a fluid injection system 200. The fluid injection system 200 can pump a fluid composition 114 through a feed pipe 116 and to the subsea conduit 118 which conveys the fluid composition 114 downhole. The fluid injection system can be, for example, a cementing system. The fluid composition can be homogeneous or heterogeneous and be in the form of a fluid, slurry, dispersion, suspension, mixture or other similar compositional state wherein the components of the mixture or composition can be combined at varying ratios. The fluid composition can be drilling mud, fresh water, sea water, or base oil.

Figure 1B:
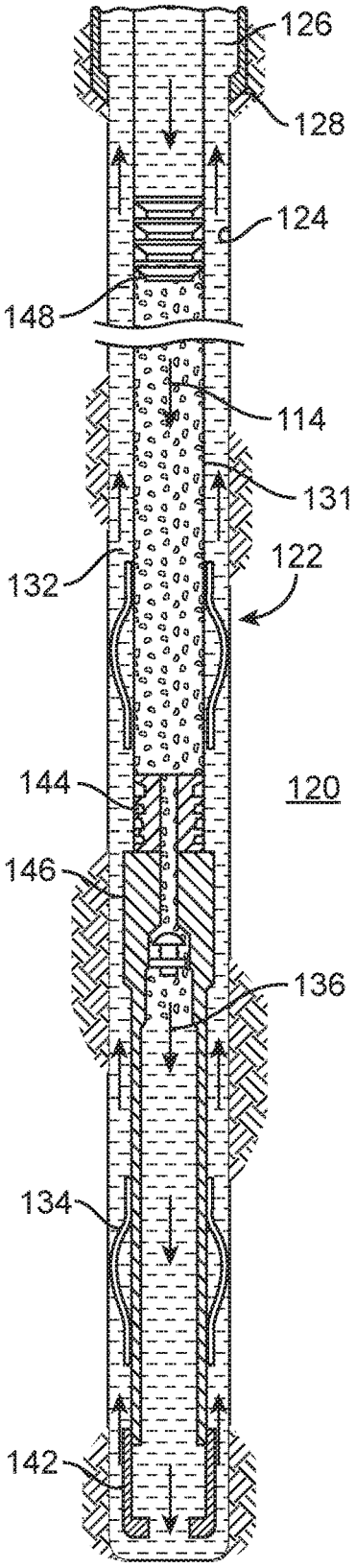
FIG. 1B is a sectional diagram of a fluid composition in a wellbore annulus in accordance with an exemplary embodiment.

Referring to FIG. 1B, the fluid composition 114 can be placed into a subterranean formation 120 in accordance with example embodiments. As illustrated, a wellbore 122 can be drilled into the subterranean formation 120. While wellbore 122 is shown extending generally vertically into the subterranean formation 120, the principles described herein are also applicable to wellbores that extend at an angle through the subterranean formation 120, such as horizontal and slanted wellbores. The wellbore 122 comprises walls 124. In the exemplary embodiments, a surface casing 126 has been inserted into the wellbore 122. The surface casing 126 can be cemented to the walls 124 of the wellbore 122 by cement sheath 128. In the exemplary embodiment, one or more additional conduits (e.g., intermediate casing, production casing, liners, etc.) shown as casing 131 can also be disposed in the wellbore 122. A wellbore annulus 132 is formed between the casing 131 and the walls 124 of the well bore 122 and/or the surface casing 126. One or more centralizers 134 can be attached to the casing 131, for example, to assist in centering the casing 131 in the wellbore 122 prior to and during the cementing operation.

With continued reference to FIG. 1B, the fluid composition 114 can be pumped down the interior of the casing 131. The fluid composition 114 can be allowed to flow down the interior of the casing 131 through a casing shoe 142 at the bottom of the casing 131 and up around the casing 131 into the wellbore annulus 132. The fluid composition 114 can be allowed to set in the wellbore annulus 132, for example, to form the cement sheath 128 that supports and positions the casing 131 in the wellbore 122. While not illustrated, other techniques can also be utilized for introduction of the fluid composition 114. By way of example, reverse circulation techniques can be used that include introducing the fluid composition 114 into the subterranean formation 120 by way of the wellbore annulus 132 instead of through the casing 131.

As it is introduced, the fluid composition 114 can displace other fluids 136, such as drilling fluids and/or spacer fluids, that may be present in the interior of the casing 131 and/or the wellbore annulus 132. At least a portion of the displaced fluids 136 can exit the wellbore annulus 132 via a flow line. Referring again to FIG. 1B, a bottom plug 144 can be introduced into the wellbore 122 ahead of the fluid composition 114, for example, to separate the fluid composition 114 from the fluids 136 that may be inside the casing 131 prior to a fluid injection operation such as, for example, a cementing operation. After the bottom plug 144 reaches a landing collar 146, a diaphragm or other suitable device ruptures to allow the fluid composition 114 through the bottom plug 144. In FIG. 1B, the bottom plug 144 is shown on the landing collar 146. In the exemplary embodiment, a top plug 148 can be introduced into the wellbore 122 behind the fluid composition 114. The top plug 148 can separate the fluid composition 114 from a displacement fluid and push the fluid composition 114 through the bottom plug 144.

Figure 2:
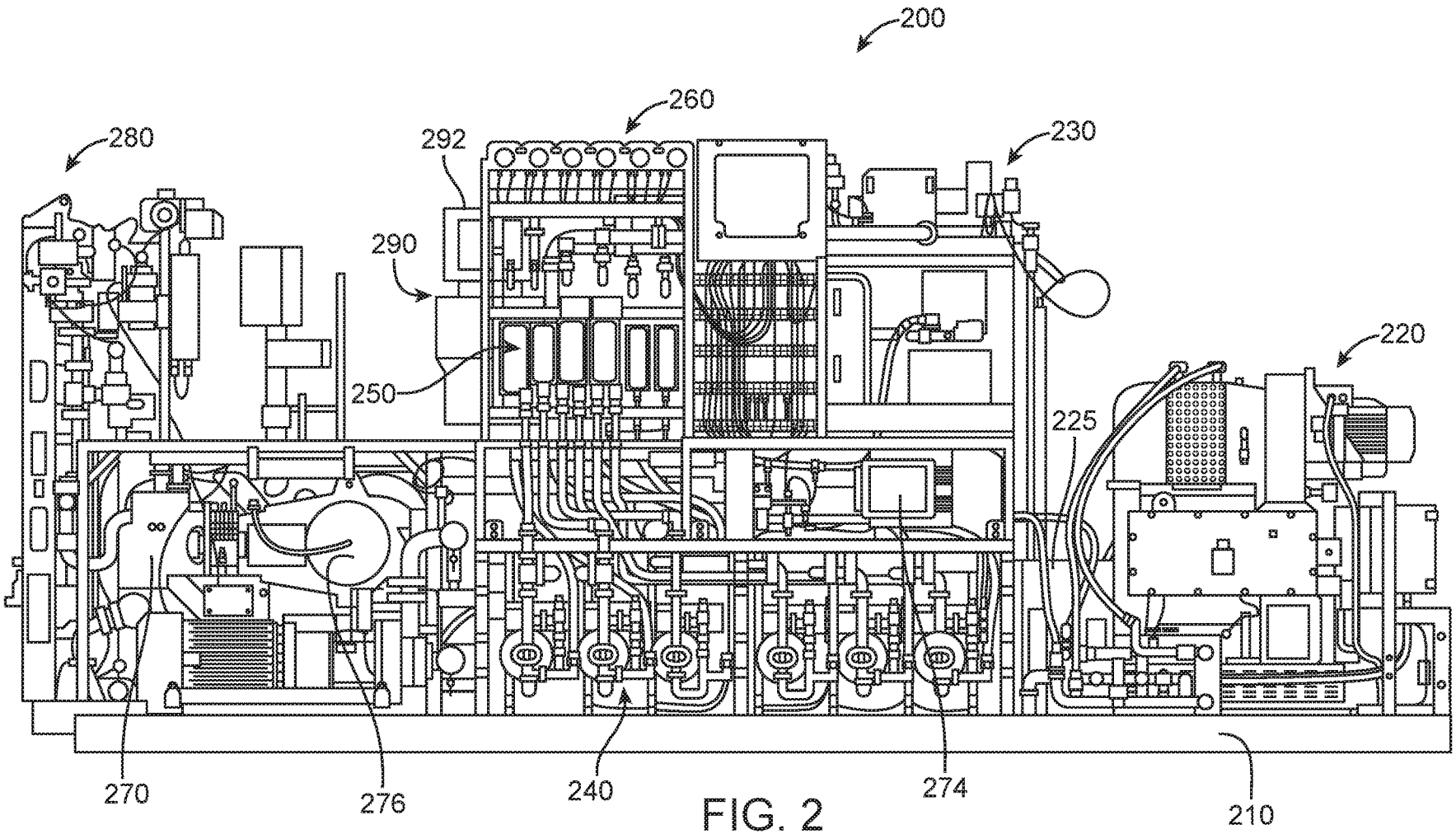
FIG. 2 is a perspective diagram of an off-shore skid-mounted fluid injection system having a high pressure fluid pump system in accordance with an exemplary embodiment.

FIG. 2 is a perspective diagram of an exemplary off-shore skid-mounted fluid injection system having a high pressure fluid pump system. The skid-mounted fluid injection system can be, for example, a cementing system. The skid-mounted fluid injection system 200 can be coupled with a hydrocarbon producing rig and configured to inject a fluid composition into a wellbore at variable degrees of pressure. Components of the skid-mounted fluid injection system 200, as described below, can be coupled with a skid 210. The skid 210 can be permanently or temporarily immobilized on the surface of the rig 110 or deck 115. In the exemplary embodiment, the fluid injection system 200 is used in off-shore oil production operations and is therefore should be permanently or temporarily immobilized on the surface of the rig 110 or deck 115. Alternatively, the skid-mounted fluid injection system 200 can be used in land-based oil production operations. In land-based operations, the skid-mounted fluid injection system 200 can be permanently or temporarily immobilized on the surface of a land-based rig, or adjacent or in substantially close proximity to the rig on a ground surface. The skid 210 can be one continuous piece of suitable weight bearing material, such as steel. Alternatively the skid 210 can be made up of a plurality of couplable sections. When the skid 210 is made up a plurality of couplable sections, each section can correspond to one or more components of the fluid injection system 200. The couplable sections, each with one or more components of the fluid injection system 200 coupled thereto, and components of the fluid injection system 200 can be assembled on-site or during manufacturing of the fluid injection system 200. In land-based operations, the fluid injection system 200 can be mounted on or coupled with a vehicle. The vehicle can be, for example, a truck. The fluid injection system 200 can be mounted on or coupled with the vehicle via skid 210. Alternatively, the fluid injection system 200 can be directly mounted on or coupled with the vehicle without the skid 210.

The fluid injection system 200 can include a power source 220, a fluid mixing system 230, a plurality of liquid additive pumps 240, a plurality of flow meters 250, a plurality of data transmitters 260, a high pressure fluid pump system 270, a high pressure discharge manifold 280, and a programmable logic control (PLC) computer 290. The power source 220 can include one or more electric or gas powered motors which are directly or indirectly coupled with various components of the fluid injection system 200 via a drive shaft 225, which translates power from the power source 220 to the various components.

The fluid mixing system 230 can have a water tank (not shown), for storage of water and/or other fluids, and mixing tank (not shown) in which one or more of fresh or salt water, fluids, dry cementing mix, additives, and other materials can be mixed to form the fluid composition. The fluid mixing system 230 can be coupled with the PLC computer 290 to monitor the amount of water or other materials therein, to control the rate of mixing in the mixing tank, test the functioning of the fluid mixing system, and perform other functions related to the fluid mixing system 230.

Liquid additives stored in storage vessels (not shown) can be added to the mixing tank via one or more of the plurality of liquid additive pumps 240. Each liquid additive pump 240 can be coupled with a corresponding storage vessel containing a distinct additive or mixture of additives. The output flow of the liquid additives from the each liquid additive pump 240 can be monitored by a corresponding one of the plurality of flow meters 250. Each flow meter 250 is coupled with a corresponding one of the plurality of data transmitters 260. The plurality of data transmitters 260 are coupled with the PLC computer 290 and transmit flow output data from the flow meters 250 to the PLC computer 290. The PLC computer 290 can control and monitor the rate of additive addition to the mixing tank, test the functioning of the liquid additive pumps 240, and perform other functions related to the movement of the liquid additives.

The high pressure fluid pump system 270 can include a large volume displacement system 300 (FIG. 3) having a large volume pump 276, which may also be a large volume high pressure pump. The power source 220 actuates the large volume pump 276 via the drive shaft 225 to pump fluid. The large volume pump 276 can have a pump rate ranging from to 50 to 1200 gallons per minute ("gpm"), alternatively 150 to 1000 gpm, and alternatively 250 to 850 gpm. The large volume pump 276 can be configured to increase fluid pressure at continuously or incrementally increasing rates which can be controlled by the PLC computer 290 in response to a pressure setting input by a user via a graphical user interface 292.

The high pressure fluid pump system 270 includes a low volume displacement system 400 (FIG. 4) having a low volume pump 472, which may also be a low volume high pressure pump, and an electric motor 274 (FIG. 2). The electric motor 274 actuates the low volume pump 472 to pump fluid. The low volume pump 472 can have a pump rate of up to 1 gallon per minute ("gpm"), alternatively 2 gpm, alternatively 5 gpm, alternatively 10 gpm, alternatively 20 gpm, alternatively, 30 gpm, alternatively 40 gpm, and alternatively 50 gpm. The low volume pump 472 can be configured to increase fluid pressure at continuously or incrementally increasing rates which can be controlled by the PLC computer 290 in response to a pressure setting input by a user via the graphical user interface 292.

The large volume pump 276 can be configured to increase fluid pressure at continuously or incrementally increasing rates, which can be controlled by the PLC computer 290 in response to a pressure setting input by a user via the graphical user interface 292. The power source 220 will displace increasing power to the large volume pump 276 via drive shaft 225, in response to the inputted pressure setting which, in turn, actuates the large volume pump 276 to cause an increase in fluid pressure. When the large volume pump 276 is configured to increase fluid pressure at an incrementally increasing rate, the rate can be larger than the rate of the low volume pump 472. When the large volume pump 276 is configured to increase fluid pressure at a continuously increasing rate, the rate can be larger than the rate of the low volume pump 472.

The fluid composition 114 containing one or more of fresh or salt water, cement mix, additives, or other fluids can be sent to the large volume pump 276 and the low volume pump 472 from the mixing tank. The large volume pump 276 and low volume pump 472 are coupled with the high pressure discharge manifold 280 and pump the fluid composition at a predetermined pressure to the high pressure discharge manifold 280. The high pressure discharge manifold 280 is coupled with the feed pipe 116 of the off-shore oil or gas rig 110 for injection into the wellbore. The high pressure fluid pump system 270 can be communicatively coupled with the PLC computer 290. The functioning of the high pressure fluid pump system 270 can be monitored, controlled and tested by the PLC computer 290.

The PLC computer can include one or more graphical user interfaces (GUIs) 292 for monitoring, controlling, or testing the functions of one or more of the individual components of the fluid injection system 200 described above. Each GUI 292 can display one or more monitoring and controlling options of a single component or multiple components of the fluid injection system 200.

Figure 3:
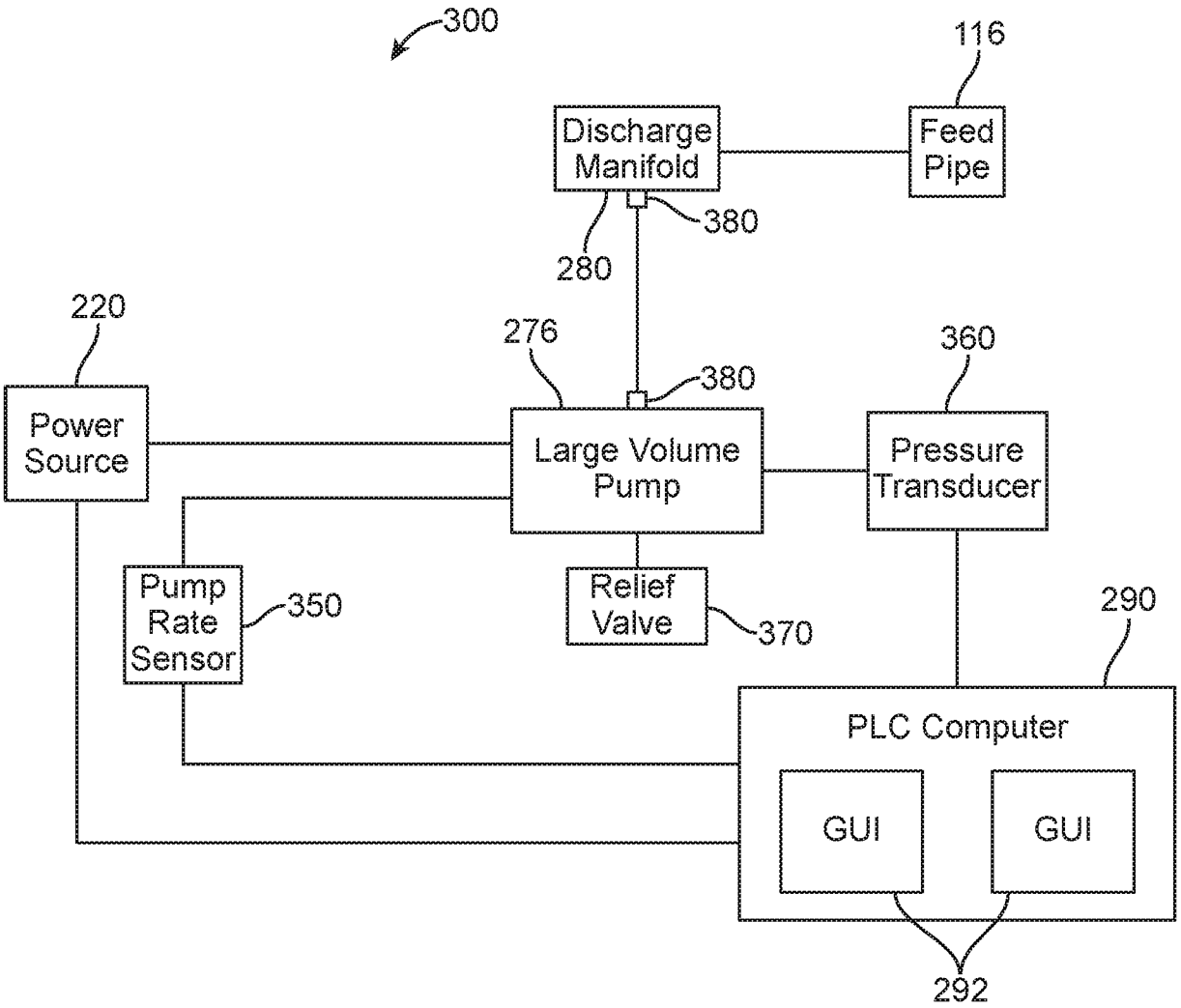
FIG. 3 is a block diagram of a large volume displacement system of a high pressure fluid pump system having a large volume high pressure pump in accordance with an exemplary embodiment.

FIG. 3 is a block diagram of an exemplary large volume displacement system 300 of the high pressure fluid pump system 270 using a large volume high pressure pump 276. The large volume pump 276 is coupled with the discharge manifold 280 of the fluid injection system 200 with a high pressure iron. The high pressure iron can be piping having a diameter of or between 1 and 6 inches, alternatively a diameter of or between 1 and 4 inches, and alternatively a diameter of or between 2 and 3 inches. The high pressure iron is coupled with the large volume pump 276 and the discharge manifold 280 with connections 380. The connections 380 can be, for example, a 1502 hammer union connection or a 2002 hammer union connection.

Power is supplied to the large volume pump 276 by the power source 220 via the drive shaft 225. The pump rate or speed of the large volume pump 276 can be controlled by the power source 220 which is coupled with the PLC computer 290. Power supplied from the power source 220 is translated to the large volume pump 276 to cause the large volume pump 276 to pump fluid. Data related to the pump speed or rate can be transmitted as a pump speed input from the large volume pump 276 to the PLC computer 290 via a pump rate sensor 350. The pump rate sensor 350 can be a magnetic pick-up device which can determine pump rate by counting the number of revolutions per minute of the drive shaft 225. The pump rate sensor 350 can alternatively be a Corioilis flow meter.

The pump speed or rate data can be communicated to the PLC computer 290 and used to calculate pump rate which can be displayed on one or more graphical user interfaces (GUIs) 292. Data related to the pressure output can be transmitted as a pressure input signal from the large volume pump 276 to the PLC computer 290 via a pressure transducer 360. The pressure transducer 360 can be a GP50 pressure transducer manufactured by Intertechnology, Inc of Toronto, Ontario, Canada. The pressure output data can be relayed to the PLC computer 290 and used to calculate output pressure which can be displayed on the one or more GUIs 292.

When a predetermined safety pressure setting (i.e., a "kickout pressure") is reached, the PLC computer 290 sends a signal to the power source 220 to terminate power generation to the large volume pump 276, thereby discontinuing increasing pressure of the pressurized fluid being pumped by large volume pump 276. The large volume displacement system 300 can include a relief valve 370 coupled to the large volume pump 276. The relief valve 370 can be set at or near the maximum allowable pressure setting of the high pressure fluid pump system 270. The relief valve 370 can be set at a pressure ranging from, for example, 5,000 to 25,000 psi. The relief valve 370 can be a high pressure relief valve manufactured by Weir Oil & Gas of Fort Worth, Tex.

Figure 4:
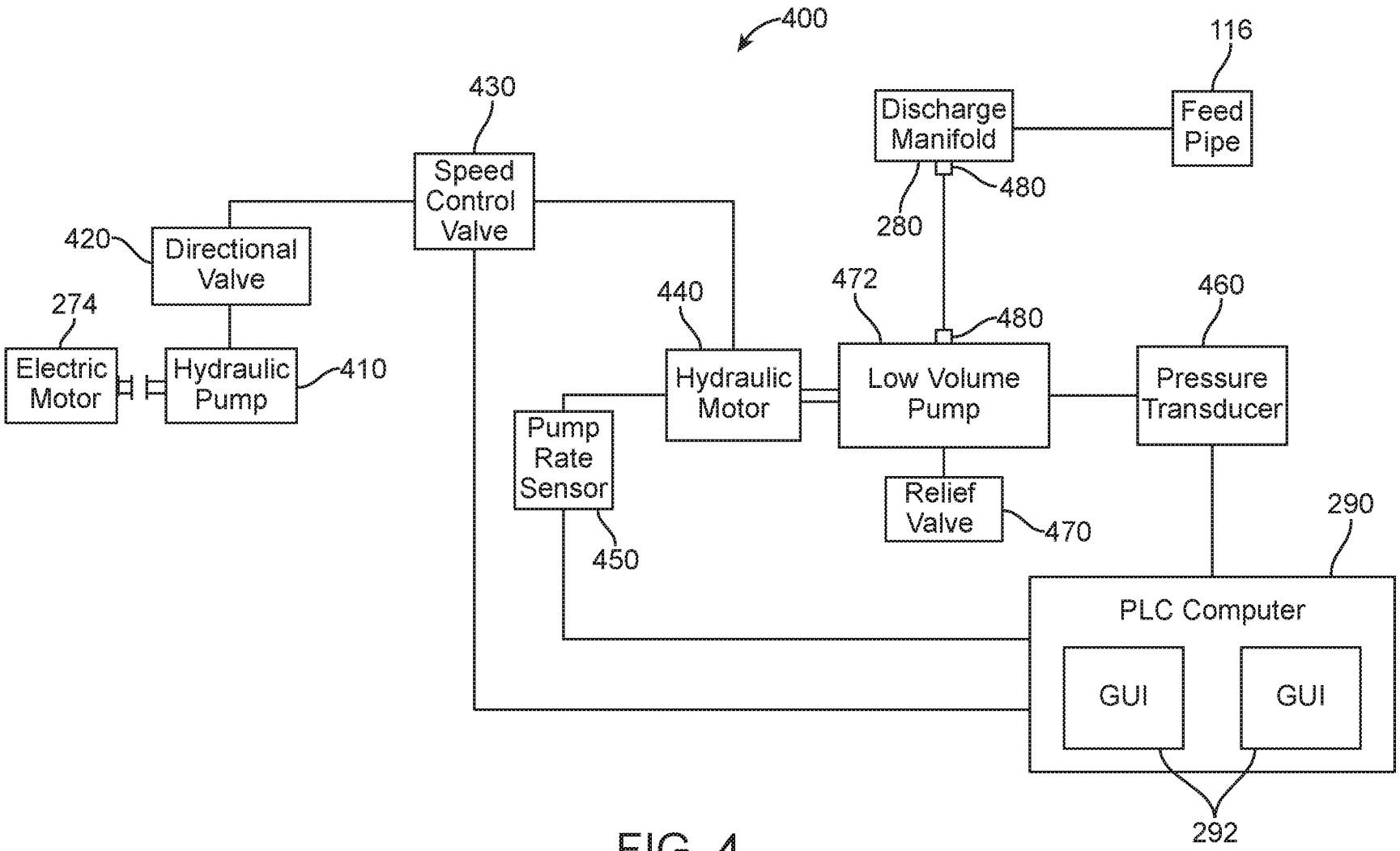
FIG. 4 is a block diagram of a low volume displacement system of the high pressure fluid pump system having a low volume high pressure pump in accordance with an exemplary embodiment.

FIG. 4 is a block diagram of an exemplary low volume displacement system 400 of the high pressure fluid pump system 270 having a low volume high pressure pump. The low volume pump 472 is coupled with the discharge manifold 280 of the fluid injection system 200 with a high pressure hose. The high pressure hose can be, for example, Polyflex® hose manufactured by Parker Hannifin Corporation. The high pressure hose is coupled with the low volume pump 472 with an autoclave type pressure fitting 480. The high pressure hose is coupled with the discharge manifold 280 with an autoclave type pressure fitting 480 machined onto a face of the discharge manifold 280 and including a special 1502 cap. The low volume pump 472 can be a K108 triplex pump manufactured by KAMAT GmbH & Co. KG of Witten, Germany. Alternatively, the low volume pump 272 can be a duplex pump, a quintuplex pump, or an intensifier pump.

Power is supplied to the low volume pump 472 by a hydraulic pump 410. The hydraulic pump 410 can be, for example, a load sense hydraulic pump manufactured by Parker Hannifin Corporation, which is powered by electric motor 274. The pump rate or speed of the low volume pump 472 can be controlled by a speed control valve 430 which is coupled to the PLC computer 290. The PLC computer 290 can send a hydraulic flow output signal to the speed control valve 430 to control the functioning of the speed control valve 430. Power supplied from the hydraulic pump 410 is translated to a hydraulic motor 440 through the speed control valve 430 to cause the low volume pump 472 to pump fluid. Data related to the pump speed or rate can be transmitted as a pump speed input from the low volume pump 472 to the PLC computer 290 via a pump rate sensor 450. The pump rate sensor 450 can be a rotary encoder such as, for example, a rotary encoder manufactured by BEI Sensors of Goleta, Calif.

The pump speed or rate data can be relayed to the PLC computer 290 and used to calculate pump rate which can be displayed on one or more GUIs 292. Data related to the pressure output can be transmitted as a pressure input signal from the low volume pump 472 to the PLC computer 290 via a pressure transducer 460. The pressure transducer can be, for example, a GP50 pressure transducer manufactured by Intertechnology, Inc. The pressure output data can be relayed to the PLC computer 290 and used to calculate output pressure which can be displayed on the one or more GUIs 292.

The low volume displacement system 400 can include a directional valve 420 coupled between hydraulic pump 410 and speed control valve 430. The directional valve 420 can be, for example, a D61VW valve manufactured by Parker Hannifin Corporation. The directional valve 420 can be used when a predetermined safety pressure setting (i.e., a "kick-out pressure") is reached, to interrupt hydraulic flow thereby discontinuing increasing pressure of the pressurized fluid being pumped by hydraulic pump 410. The low volume displacement system 400 further includes a relief valve 470 coupled to the low volume pump 472. The relief valve 470 serves as a secondary safety feature in addition to the directional valve 420 and is set at or near the maximum allowable pressure setting of the high pressure fluid pump system 270. The relief valve 470 can be set at a pressure ranging from, for example, 5,000 to 25,000 psi. The relief valve can be, for example, a high pressure relief valve manufactured by Haskel International, Inc.

Figure 5:
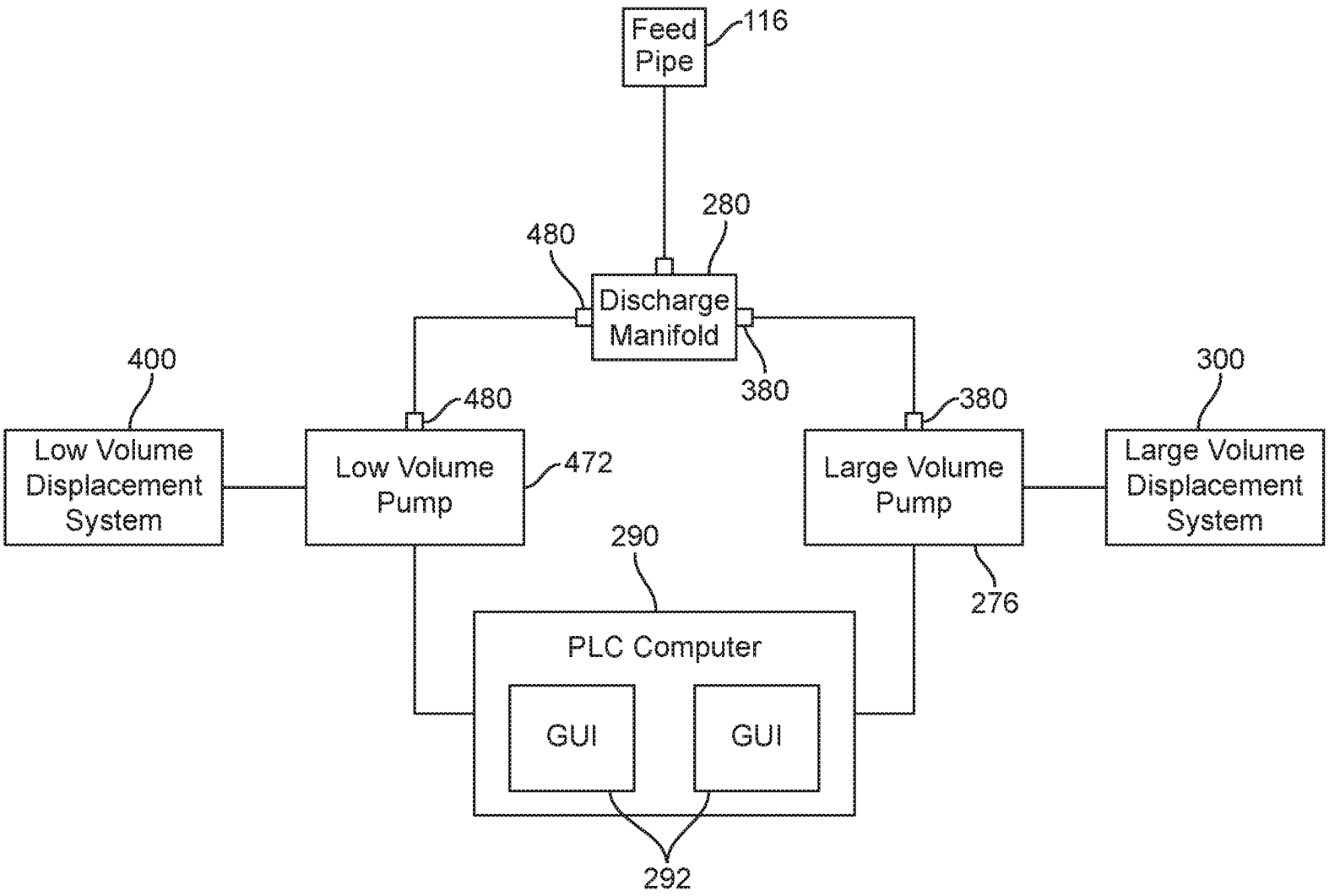
FIG. 5 is a block diagram illustrating the large volume displacement system of FIG. 3 and the low volume displacement system of FIG. 4 of the high pressure fluid pump system in accordance with an exemplary embodiment.

FIG. 5 is a block diagram illustrating the exemplary large volume displacement system 300 of FIG. 3 and the exemplary low volume displacement system 400 of FIG. 4 of the high pressure fluid pump system 270. As described above the large volume displacement system 300 includes large volume pump 276 and the low volume displacement system 400 includes the low volume pump 472. As, as described above, the large volume displacement system 300 and large volume pump 276, and the low volume displacement system 400 and the low volume pump 472 are coupled to PLC computer 290 which monitors, controls and tests, the components of high pressure fluid pump system 270. The GUIs 292 can be used to observe or change operational parameters high pressure fluid pump system 270 via the PLC computer 290. As previously described, the large volume pump 276 is coupled with the discharge manifold 280 by a connection 380 and low volume pump 472 is coupled with the discharge manifold 280 of the fluid injection system 200 by a autoclave type pressure fitting 480.

Figure 6:
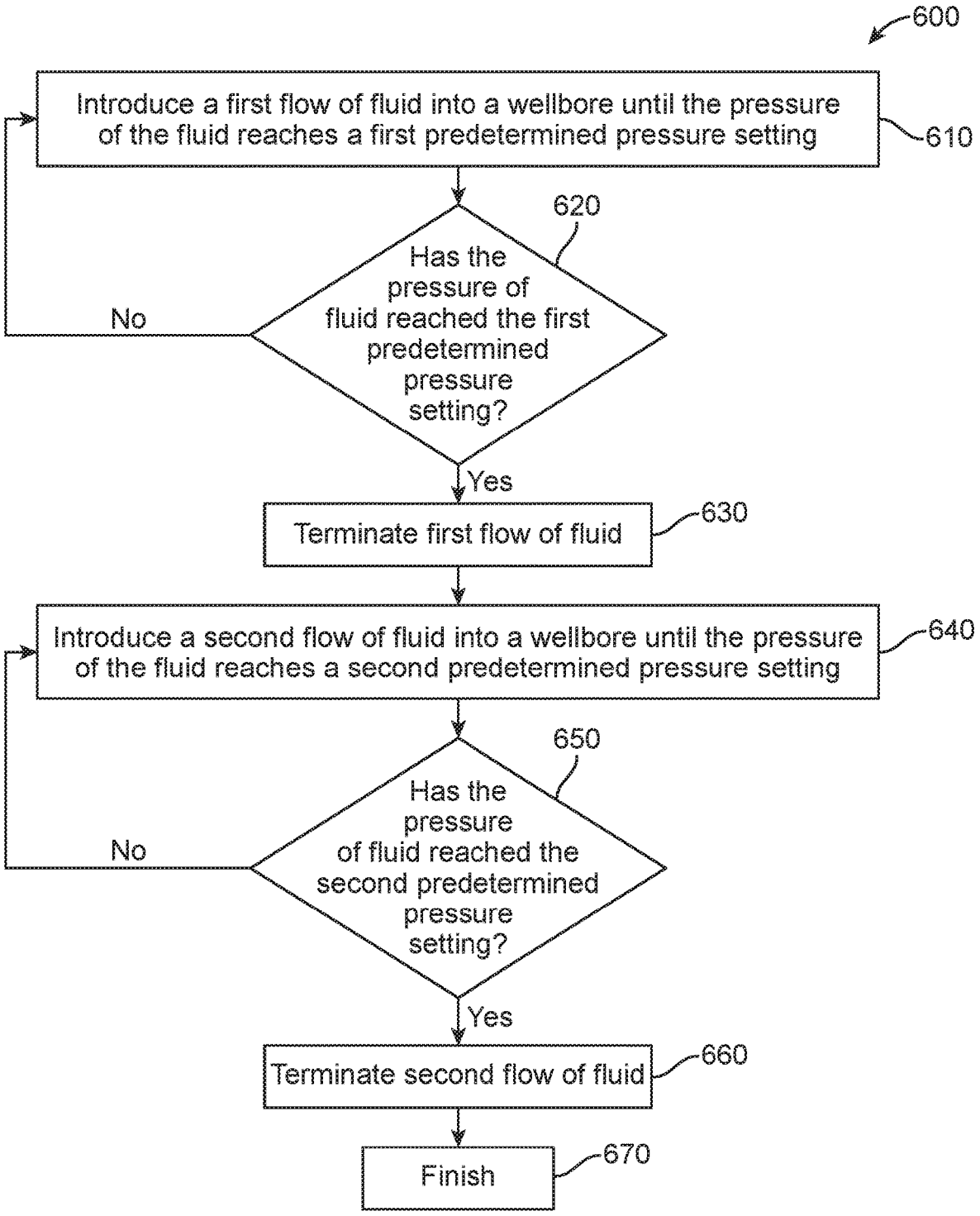
FIG. 6 is a flow diagram illustrating an exemplary method for regulating the pressure of a fluid composition using the fluid injection system of FIG. 2 in accordance with an exemplary embodiment.

FIG. 6 is a flow diagram illustrating an exemplary method for regulating the pressure of a fluid composition using the fluid injection system 200. The exemplary method 600 is provided by way of example, as there are a variety of ways to carry out the method. The method 600 described below can be carried out using the configurations illustrated in FIGS. 1-5 by way of example, and various elements of these figures are referenced in explaining exemplary method 600. Each block shown in FIG. 6 represents one or more processes, methods or subroutines, carried out in the exemplary method 600. The exemplary method 600 can begin at block 610.

At block 610, a first flow of fluid is introduced into a wellbore. The first flow of fluid can be introduced at an incrementally or continuously increasing pressure. The first flow of fluid is introduced at an incrementally or continuously increasing pressure until the pressure of the fluid reaches a first predetermined pressure setting below a maximum pressure setting. For example, the flow of fluid is introduced into the wellbore 122 at an incrementally or continuously increasing pressure, using the large volume displacement system 300 having the large volume pump 276. The first predetermined pressure setting can be 80% of the maximum pressure setting. Alternatively, the first predetermined pressure setting can be 50% of the maximum pressure setting, alternatively, 60% of the maximum pressure setting, alternatively, 70% of the maximum pressure setting, alternatively, 90% of the maximum pressure setting, and alternatively, 95% of the maximum pressure setting. Alternatively, the first predetermined pressure setting can be any value set by a user using the GUI 292. The large volume pump 276 can have a pump rate ranging from 50 to 1200 gallons per minute ("gpm"), alternatively 150 to 1000 gpm, and alternatively 250 to 850 gpm. Alternatively, the large volume pump 276 can have any pump rate suitable for a desired fluid injection operation. After a flow of fluid is introduced into the wellbore at an incrementally or continuously increasing pressure until the pressure of the fluid reaches the first predetermined pressure setting, the method 600 can proceed to block 620.

At block 620, a determination is made as to whether the first predetermined pressure setting has been reached. If the first predetermined pressure setting has not been reached, the method returns to block 610. If the first predetermined pressure setting has been reached, the method can proceed to block 630.

At block 630, the first flow of fluid is terminated. The first flow of fluid can be terminated by inputting a corresponding instruction to the PLC computer 290 via GUI 292 to terminate the first flow of fluid from the large volume displacement system 300. The PLC computer 290 can be instructed to terminate the first flow of fluid upon reaching the first predetermined pressure setting or at any time upon a user request. After the first flow of fluid has been terminated, the method can proceed to block 640.

In block 640, a second flow of fluid is introduced into the wellbore 122. The second flow of fluid can be introduced at an incrementally or continuously increasing pressure. The second flow of fluid is introduced at an incrementally or continuously increasing pressure until the pressure of the fluid reaches a second predetermined pressure setting, which is above the first predetermined pressure setting and at or below the maximum pressure setting. For example, the second flow of fluid is introduced into the wellbore 122 at an incrementally or continuously increasing pressure using the low volume displacement system 300 having the low volume pump 472. The low volume pump can have a pump rate of up to 1 gallon per minute ("gpm"), alternatively 2 gpm, alternatively 5 gpm, and alternatively 10 gpm, alternatively 20 gpm, alternatively 30 gpm, alternatively 40 gpm, and alternatively 50 gpm. Alternatively, the low volume pump 472 can have any pump rate suitable for a desired fluid injection operation. After the second flow of fluid is introduced into the wellbore 122 at an incrementally or continuously increasing pressure until the pressure of the fluid reaches the second predetermined pressure setting, the method 600 can proceed to block 650.

At block 650, a determination is made as to whether the second predetermined pressure setting has exceeded the maximum pressure setting. If the second predetermined pressure setting has not exceeded the maximum pressure setting, the predetermined pressure setting can be maintained for introduction of the fluid composition 114 into the wellbore 122. Alternatively, if the second predetermined pressure setting has not exceeded the maximum pressure setting the method 600 can proceed to block 660.

At block 660, the second flow of fluid is terminated. The second flow of fluid can be terminated by inputting a corresponding instruction to the PLC computer 290 via GUI 292 to terminate the first flow of fluid from the low volume displacement system 300. The PLC computer 290 can be instructed to terminate the second flow of fluid upon reaching the first predetermined pressure setting or at any time upon a user request. After the second flow of fluid has been terminated, the method can proceed to block 670, where the method 600 ends.

As discussed above, the PLC computer 290 can monitor for example, pump rate and pressure of the fluid injection system 200, and output data to the GUI 292 for viewing. A "kickout" pressure setting can be input into the PLC computer 290 via the GUI 292. The kickout pressure setting corresponds to a pressure which will actuate the directional valve 420 to interrupt hydraulic flow thereby discontinuing the increase of pressure of the fluid being pumped. The kickout pressure can be equal to, or less than, the maximum pressure setting of the system. At any of blocks 610-670, upon exceeding the maximum pressure setting, the PLC computer actuates the directional valve 420, to interrupt hydraulic flow thereby discontinuing increasing pressure of the pressurized fluid being pumped by hydraulic pump 410. If the hydraulic flow has been interrupted by actuation of the directional valve 420, the method proceeds to block 680, where the method 600 ends.

Figure 7:
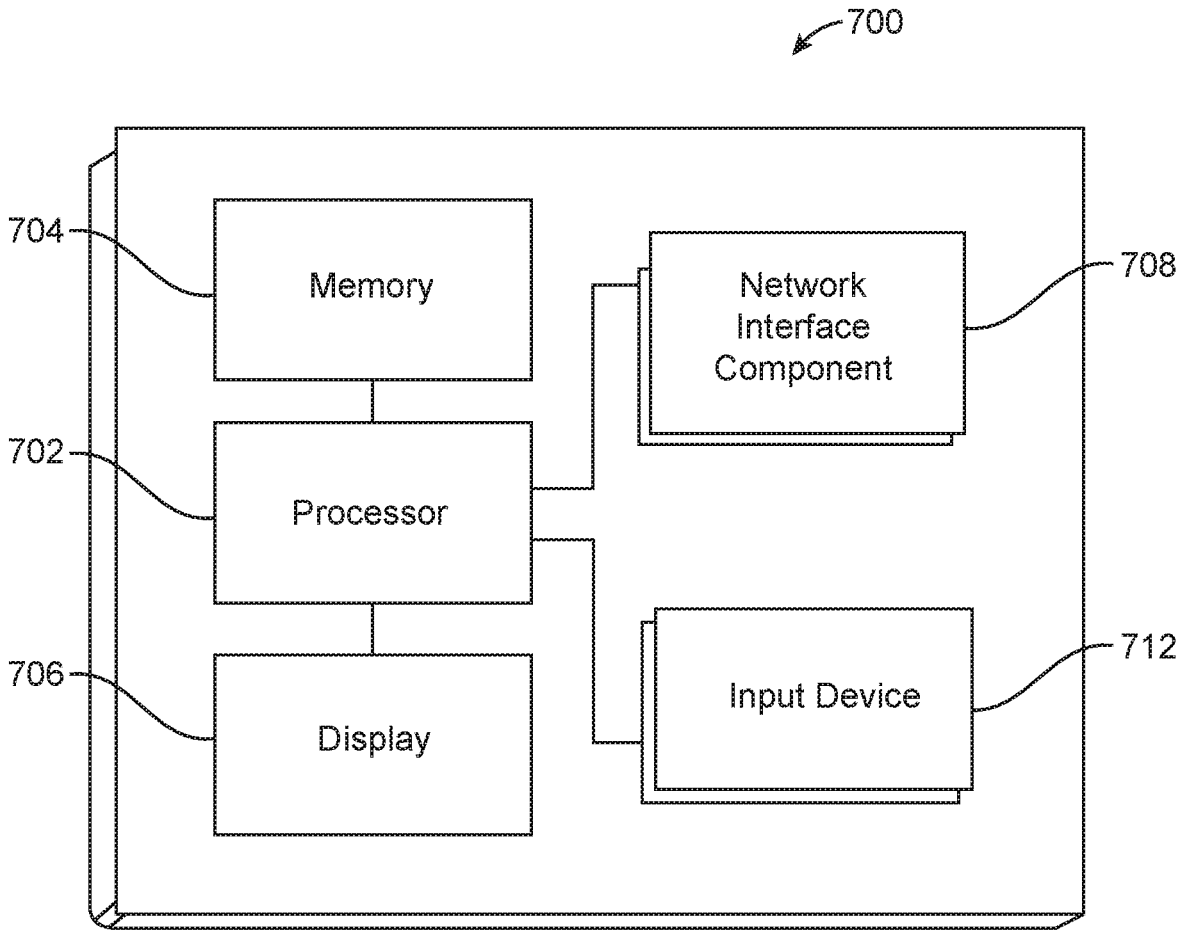
FIG. 7 illustrates a logical arrangement of a set of general components of an example computing device that can be utilized in accordance with various embodiments.

Referring to FIG. 7, a block diagram of a computing device in accordance with an exemplary embodiment is illustrated. The computing device 700 can be the programmable logic controller (PLC) 290 described above. A PLC can be an industrial computer control system that continuously monitors the state of input devices and makes decision based upon a program to control the state of one or more output devices. As such the PLC is a dedicated computing device. The computing device 700 may be a computer. In this example, the computing device 700 includes a processor or central processing unit (CPU) 702 for executing instructions that can be stored in a memory 704. As would be apparent to one of ordinary skill in the art, the device can include many types of memory, data storage, or non-transitory computer-readable storage media, such as a first data storage for program instructions for execution by the processor 702, a separate storage for images or data, a removable memory for sharing information with other devices, etc. The device typically will include some type of display 706, such as a touch screen or liquid crystal display (LCD), although devices such as portable media players might convey information via other means, such as through audio speakers. The display 706 can be part of the computing device 700 as shown. Alternatively, the display 706 can be communicatively coupled with the computing device 700 as shown in FIG. 3. The computing device 700 can include at least one input device 712 able to receive conventional input from a user. This conventional input can include, for example, a push button, touch pad, touch screen, keyboard, mouse, keypad, or any other such device or element whereby a user can input a command to the device. The computing device 700 of FIG. 7 can include one or more network interface components 708 for communicating over various networks, such as a Wi-Fi, Bluetooth, RF, wired, or wireless communication systems. The device can communicate with a network, such as the Internet, and may be able to communicate with other such devices.

Each computing device typically will include an operating system that provides executable program instructions for the general administration and operation of that device and typically will include computer-readable medium storing instructions that, when executed by a processor of the server, allow the computing device to perform its intended functions. Suitable implementations for the operating system and general functionality of the servers are known or commercially available and are readily implemented by persons having ordinary skill in the art, particularly in light of the disclosure herein.

The pressure regulation apparatus as disclosed herein can be implemented in a wide variety of operating environments, which in some cases can include one or more user computers, computing devices, or processing devices which can be used to operate any of a number of applications. User or client devices can include any of a number of general purpose personal computers, such as desktop or laptop computers running a standard operating system, as well as cellular, wireless, and handheld devices running mobile software and capable of supporting a number of networking and messaging protocols. Such a system also can include a number of workstations running any of a variety of commercially-available operating systems and other known applications for purposes such as development and database management. These devices also can include other electronic devices, such as dummy terminals, thin-clients, and other devices capable of communicating via a network.

Each computing device 700 typically will include an operating system that provides executable program instructions for the general administration and operation of that device and typically will include computer-readable medium storing instructions that, when executed by a processor of the server, allow the computing device to perform its intended functions. Suitable implementations for the operating system and general functionality of the computing devices are known or commercially available and are readily implemented by persons having ordinary skill in the art, particularly in light of the disclosure herein.

Any necessary files for performing the functions attributed to the computing devices 700 can be stored locally and/or remotely, as appropriate. Where a system includes computerized devices, each such device can include hardware elements that may be electrically coupled via a bus, the elements including, for example, at least one central processing unit (CPU), at least one input device (e.g., a mouse, keyboard, controller, touch screen, or keypad), and at least one output device (e.g., a display device, printer, or speaker). Such a system may also include one or more storage devices, such as disk drives, optical storage devices, and solid-state storage devices such as random access memory ("RAM") or read-only memory ("ROM"), as well as removable media devices, memory cards, flash cards, etc.

Such devices also can include a computer-readable storage media reader, a communications device (e.g., a modem, a network card (wireless or wired), an infrared communication device, etc.), and working memory as described above. The computer-readable storage media reader can be connected with, or configured to receive, a computer-readable storage medium, representing remote, local, fixed, and/or removable storage devices as well as storage media for temporarily and/or more permanently containing, storing, transmitting, and retrieving computer-readable information. The system and various devices also typically will include a number of software applications, modules, services, or other elements located within at least one working memory device, including an operating system and application programs, such as a client application or Web browser. It should be appreciated that alternate embodiments may have numerous variations from that described above. For example, customized hardware might also be used and/or particular elements might be implemented in hardware, software (including portable software, such as applets), or both. Further, connection to other computing devices such as network input/output devices may be employed.

Storage media and computer readable media for containing code, or portions of code, can include any appropriate media known or used in the art, including storage media and communication media, such as but not limited to volatile and non-volatile, removable and non-removable media implemented in any method or technology for storage and/or transmission of information such as computer readable instructions, data structures, program modules, or other data, including RAM, ROM, EEPROM, flash memory or other memory technology, CD-ROM, digital versatile disk (DVD) or other optical storage, magnetic cassettes, magnetic tape, magnetic disk storage or other magnetic storage devices, or any other medium which can be used to store the desired information and which can be accessed by a system device. Based on the disclosure and teachings provided herein, a person of ordinary skill in the art will appreciate other ways and/or methods to implement the various embodiments.

As used herein and above, "cement" or "cement composition" is any kind of material capable of being pumped to flow to a desired location, and capable of setting into a solid mass at the desired location. In many cases, common calcium-silicate hydraulic cement is suitable, such as Portland cement. Calcium-silicate hydraulic cement includes a source of calcium oxide such as burnt limestone, a source of silicon dioxide such as burnt clay, and various amounts of additives such as sand, pozzolan, diatomaceous earth, iron pyrite, alumina, and calcium sulfate. In some cases, the cement may include polymer, resin, or latex, either as an additive or as the major constituent of the cement. The polymer may include polystyrene, ethylene/vinyl acetate copolymer, polymethylmethacrylate polyurethanes, polylactic acid, polyglycolic acid, polyvinylalcohol, polyvinylacetate, hydrolyzed ethylene/vinyl acetate, silicones, and combinations thereof. The cement may also include reinforcing fillers such as fiberglass, ceramic fiber, or polymer fiber. The cement may also include additives for improving or changing the properties of the cement, such as set accelerators, set retarders, defoamers, fluid loss agents, weighting materials, dispersants, density-reducing agents, formation conditioning agents, lost circulation materials, thixotropic agents, suspension aids, or combinations thereof.

The cement compositions disclosed herein may directly or indirectly affect one or more components or pieces of equipment associated with the preparation, delivery, recapture, recycling, reuse, and/or disposal of the disclosed cement compositions. For example, the disclosed cement compositions may directly or indirectly affect one or more mixers, related mixing equipment, mud pits, storage facilities or units, composition separators, heat exchangers, sensors, gauges, pumps, compressors, and the like used to generate, store, monitor, regulate, and/or recondition the exemplary cement compositions. The disclosed cement compositions may also directly or indirectly affect any transport or delivery equipment used to convey the cement compositions to a well site or downhole such as, for example, any transport vessels, conduits, pipelines, trucks, tubulars, and/or pipes used to compositionally move the cement compositions from one location to another, any pumps, compressors, or motors (e.g., topside or downhole) used to drive the cement compositions into motion, any valves or related joints used to regulate the pressure or flow rate of the cement compositions, and any sensors (i.e., pressure and temperature), gauges, and/or combinations thereof, and the like. The disclosed cement compositions may also directly or indirectly affect the various downhole equipment and tools that may come into contact with the cement compositions/additives such as, but not limited to, wellbore casing, wellbore liner, completion string, insert strings, drill string, coiled tubing, slickline, wireline, drill pipe, drill collars, mud motors, downhole motors and/or pumps, cement pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like.

Statements of the Disclosure Include

Statement 1: A pressure regulation apparatus comprising a large volume displacement system configured to increase a pressure of a fluid in a downhole to a predetermined pressure setting below a maximum pressure setting and comprising a large volume pressure pump and a primary pressure sensor coupled with the large volume pressure pump; a low volume displacement system configured to increase the pressure of the fluid from the predetermined pressure setting to a pressure setting above the predetermined pressure setting and at or below the maximum pressure setting and comprising a low volume pressure pump having a lower volume than the large volume pressure pump, and a secondary pressure sensor coupled with the low volume pressure pump; a programmable logic control (PLC) computer coupled with each of the primary pressure sensor and the secondary pressure sensor.

Statement 2: The pressure regulation apparatus according to Statement 1, wherein the large volume displacement system and the low volume displacement system are configured to increase the pressure of the fluid at a continuously or incrementally increasing rate.

Statement 3: The pressure regulation apparatus according to Statement 2, wherein the continuously increasing rate of the large volume displacement system is larger than the continuously increasing rate of the low volume displacement system.

Statement 4: The pressure regulation apparatus according to Statement 4, wherein the increment of increasing rate of the large volume displacement system is larger than the increment of increasing rate of the low volume displacement system.

Statement 5: The pressure regulation apparatus according to any one of Statements 1-4, wherein the pressure regulation apparatus further comprises a hydraulic pump powered by a power source to provide hydraulic power to the low volume pressure pump, and a directional safety valve coupled between the hydraulic pump and a speed control valve to regulate the hydraulic power from the hydraulic pump; the large volume displacement system further comprises a pump rate sensor coupled with the large volume pressure pump; and the low volume displacement system further comprises a pump rate sensor coupled with the low volume pressure pump, the speed control valve coupled with the low volume pressure pump; wherein the PLC computer is further coupled with the pump rate sensors and the speed control valve.

Statement 6: The pressure regulation apparatus according to Statement 5, wherein the pump rate sensor of the low volume displacement system is an optical rotary encoder.

Statement 7: The pressure regulation apparatus according to any one of Statements 1-6, wherein each of the primary pressure sensor and the secondary pressure sensor comprise a pressure transducer to measure the pressure outputted from the large volume pressure pump and the low volume pressure pump.

Statement 8: The pressure regulation apparatus according to any one of Statements 1-7, wherein the hydraulic pump power source is any of an electric powered motor or a gas powered motor.

Statement 9: The pressure regulation apparatus according to any one of Statements 1-8, further comprising a pressure relief valve coupled with the low volume pressure pump for preventing overpressurization of the low pressure pump.

Statement 10: The pressure regulation apparatus according to any one of Statements 1-9, further comprising a graphical user interface operating on the PLC computer and configured to receive commands to control the pressure regulation apparatus.

Statement 11: The pressure regulation apparatus according to any one of Statements 1-10, wherein the low volume pressure pump is one of a duplex pump, a triplex pump, a quintuplex pump, or an intensifier pump.

Statement 12: A pressure regulation system comprising a fluid injection system in fluid communication with a wellbore, a pressure regulation apparatus according to any one of Statements 1-11 integrated into the fluid injection system, and a wellbore coupled with the cementing skid via a wellhead, wherein the large volume displacement system configured to increase a pressure of a fluid in the wellbore to a predetermined pressure setting below a maximum pressure setting, and wherein the low volume displacement system is configured to increase the pressure of the fluid from the predetermined pressure setting to a pressure setting above the predetermined pressure setting and at or below the maximum pressure setting.

Statement 13: A method of regulating the pressure of a fluid in a wellbore comprising introducing a first flow of fluid into a wellbore at a incrementally or continuously increasing pressure, using a large volume displacement system comprising a large volume pressure pump, until the pressure of the fluid reaches a first predetermined pressure setting below a maximum pressure setting; terminating the flow of fluid from the large volume displacement system when the pressure of the fluid reaches the first predetermined pressure setting; and introducing a second flow of fluid into the wellbore at a incrementally or continuously increasing pressure, using a low volume displacement system comprising a low volume pressure pump having a lower volume than the large volume pressure pump, until the pressure of the fluid reaches a second predetermined pressure setting above the first predetermined pressure setting and at or below the maximum pressure setting.

Statement 14: A method of regulating the pressure of a fluid in a wellbore according to Statement 13, wherein introduction of the flow of fluid into the wellbore at incrementally or continuously increasing pressure using the low volume displacement system is performed at a pump rate up to 50 gallons per minute.

Statement 15: A method of regulating the pressure of a fluid in a wellbore according to any one of Statements 13-14, further comprising controlling, with a programmable logic control (PLC) computer, the introduction of the flow of fluid into the wellbore at incrementally or continuously increasing pressure using the secondary pressure.

Statement 16: A method of regulating the pressure of a fluid in a wellbore according to Statement 15, further comprising inputting one or more control parameters to be performed by the PLC computer, and monitoring pressure within the wellbore.

Statement 17: A method of regulating the pressure of a fluid in a wellbore according to Statement 16, wherein inputting and monitoring is performed using a graphical user interface.

Statement 18: A method of regulating the pressure of a fluid in a wellbore according to any one of Statements 16-17, wherein the one or more control parameters comprises a kickout pressure setting.

Statement 19: A method of regulating the pressure of a fluid in a wellbore according to Statement 18, wherein introduction of the flow of fluid into the wellbore at incrementally or continuously increasing pressure using the low volume displacement system is performed at a pump rate of up to 50 gallons per minute.

Statement 20: A method of regulating the pressure of a fluid in a wellbore according to any one of Statements 18-19, wherein the kickout pressure is equal to the maximum pressure setting.

Statement 21: A method of regulating the pressure of a fluid in a wellbore according to any one of Statements 13-20, wherein the predetermined pressure setting is not more than 80% of the maximum pressure setting.

Statement 22: A method of regulating the pressure of a fluid in a wellbore according to any one of Statements 13-20, wherein the predetermined pressure setting is not more than 90% of the maximum pressure setting.

Statement 23: A method of regulating the pressure of a fluid in a wellbore according to any one of Statements 13-22, further comprising shutting off the flow of fluid from the large volume displacement system when the predetermined pressure level has been reached.

Statement 24: A method of regulating the pressure of a fluid in a wellbore according to any one of Statements 13-23 in a system according to Statement 12.

The foregoing descriptions of specific compositions and methods of the present disclosure have been presented for purposes of illustration and description. They are not intended to be exhaustive or to limit the disclosure to the precise compositions and methods disclosed and obviously many modifications and variations are possible in light of the above teaching. The examples were chosen and described in order to best explain the principles of the disclosure and its practical application, to thereby enable others skilled in the art to best utilize the disclosure with various modifications as are suited to the particular use contemplated. It is intended that the scope of the disclosure be defined by the claims appended hereto and their equivalents.

What is claimed:

1. A pressure regulation apparatus comprising:

a large volume displacement system configured to increase pressure of a fluid in a wellbore until a predetermined setting below a maximum pressure setting, the large volume displacement system comprising:

a large volume pressure pump; and a primary pressure sensor coupled with the large volume pressure pump;

a low volume displacement system configured to increase the pressure of the fluid from the predetermined pressure setting to a pressure setting above the predetermined pressure setting and at or below the maximum pressure setting, the low volume displacement system comprising:

a low volume pressure pump, having a lower volume than the large volume pressure pump; and a secondary pressure sensor coupled with the low volume pressure pump; and a programmable logic control (PLC) computer coupled with the primary pressure sensor and the secondary pressure sensor, a graphical user interface operating on the PLC computer and configured to receive commands to control the pressure regulation apparatus;

wherein the large volume pressure pump and the small volume pressure pump pump via a same discharge manifold and feed pipe into a wellbore;

a hydraulic pump to provide hydraulic power to the low volume pressure pump; and a directional safety valve interposed between the hydraulic pump and a speed control valve, the directional safety valve regulates the hydraulic power from the hydraulic pump;

the large volume displacement system further comprises:

a pump rate sensor coupled with the large volume pressure pump; and the low volume displacement system further comprises:

a pump rate sensor coupled with the low volume pressure pump; and the speed control valve coupled with the low volume pressure pump, wherein the PLC computer is further coupled with the pump rate sensors and the speed control valve.

2. The pressure regulation apparatus of claim 1, wherein the large volume displacement system and the low volume displacement system are configured to increase the pressure of the fluid at a continuously or incrementally increasing rate.

3. The pressure regulation apparatus of claim 2, wherein the continuously increasing rate of the large volume displacement system is larger than the continuously increasing rate of the low volume displacement system.

4. The pressure regulation apparatus of claim 2, wherein the increment of increasing rate of the large volume displacement system is larger than the increment of increasing rate of the low volume displacement system.

5. The apparatus of claim 1, wherein the pump rate sensor of the low volume displacement system is an optical rotary encoder.

6. The apparatus of claim 1, wherein each of the primary pressure sensor and the secondary pressure sensor comprise a pressure transducer to measure the pressure outputted from the large volume pressure pump and the low volume pressure pump.

7. The apparatus of claim 1, wherein a hydraulic pump power source comprises one of an electric powered motor or a gas powered motor.

8. The apparatus of claim 1, further comprising a pressure relief valve coupled with the low volume pressure pump for preventing overpressurization of the low pressure pump.

9. The apparatus of claim 1, wherein the low volume pressure pump is one of a duplex pump, a triplex pump, a quintuplex pump, or an intensifier pump.

10. The apparatus of claim 1 further comprising a first motor for driving the large volume pressure pump, and a second motor for driving the low volume pressure pump.

11. The apparatus of claim 1 wherein the large volume pressure pump and the low volume pressure pump are mounted to a skid.

12. A pressure regulation system comprising:

a fluid injection system in fluid communication with a wellbore via a wellhead;

a pressure regulation apparatus integrated into the fluid injection system and comprising:

a large volume displacement system configured to increase a pressure of a fluid in the wellbore to a predetermined pressure setting below a maximum pressure setting, the large volume displacement system comprising:

a large volume pressure pump; and a primary pressure sensor coupled with the large volume pressure pump;

a low volume displacement system configured to increase the pressure of the fluid from the predetermined pressure setting to a pressure setting above the predetermined pressure setting and at or below the maximum pressure setting, the low volume displacement system comprising:

a low volume pressure pump, having a lower volume than the large volume pressure pump; and a secondary pressure sensor coupled with the low volume pressure pump;

a programmable logic control (PLC) computer coupled with the primary pressure sensor and the secondary pressure sensor, a wellhead, wherein the large volume pressure pump and the small volume pressure pump pump via a same discharge manifold and feed pipe into a wellbore;

a hydraulic pump to provide hydraulic power to the low volume pressure pump; and a directional safety valve interposed between the hydraulic pump and a speed control valve, the directional safety valve regulates the hydraulic power from the hydraulic pump;

the large volume displacement system further comprises:

a pump rate sensor coupled with the large volume pressure pump; and the low volume displacement system further comprises:

a pump rate sensor coupled with the low volume pressure pump; and the speed control valve coupled with the low volume pressure pump, wherein the PLC computer is further coupled with the pump rate sensors and the speed control valve.

13. The system of claim 12, further comprising a pressure relief valve coupled with the low volume pressure pump.

14. The system of claim 12, further comprising a graphical user interface coupled with the PLC computer and configured to receive commands to control the pressure regulation apparatus.

15. A method of regulating the pressure of a fluid in a wellbore comprising:

introducing a first flow of fluid into a wellbore at a incrementally or continuously increasing pressure, using a large volume displacement system comprising a large volume pressure pump, until the pressure of the fluid reaches a first predetermined pressure setting below a maximum pressure setting;

terminating the flow of fluid from the large volume displacement system when the pressure of the fluid reaches the first predetermined pressure setting; and introducing a second flow of fluid into the wellbore at a incrementally or continuously increasing pressure, using a low volume displacement system comprising a low volume pressure pump having a lower volume than the large volume pressure pump, until the pressure of the fluid reaches a second predetermined pressure setting above the first predetermined pressure setting and at or below the maximum pressure setting, wherein the large volume pressure pump and the small volume pressure pump pump via a same discharge manifold and feed pipe into a wellbore, and wherein the pressure regulation apparatus comprises the large volume displacement system and the low volume displacement system, the pressure regulation apparatus further comprising a hydraulic pump to provide hydraulic power to the low volume pressure pump; and a directional safety valve interposed between the hydraulic pump and a speed control valve, the directional safety valve regulates the hydraulic power from the hydraulic pump; and the large volume displacement system further comprising:

a pump rate sensor coupled with the large volume pressure pump; and the low volume displacement system further comprising:

a pump rate sensor coupled with the low volume pressure pump; and the speed control valve coupled with the low volume pressure pump, wherein the PLC computer is further coupled with the pump rate sensors and the speed control valve.

16. The method of claim 15, wherein introduction of the flow of fluid into the wellbore at incrementally or continuously increasing pressure using the low volume displacement system is performed at a pump rate up to 50 gallons per minute.

17. The method of claim 15, further comprising controlling, with a programmable logic control (PLC) computer, the introduction of the flow of fluid into the wellbore at incrementally or continuously increasing pressure using the low volume displacement system.

18. The method of claim 17, further comprising:

inputting one or more control parameters to be performed by the PLC computer; and monitoring pressure within the wellbore.

19. The method claim 18, wherein inputting and monitoring is performed using a graphical user interface.

20. The method of claim 18, wherein the one or more control parameters comprises a kickout pressure setting.

21. The method of claim 20, wherein introduction of the flow of fluid into the wellbore at incrementally or continuously increasing pressure using the low volume displacement system is performed at a pump rate of up to 50 gallons per minute.

22. The method of claim 20, wherein the kickout pressure setting is equal to the maximum pressure setting.

23. The method of claim 15, wherein the predetermined pressure setting is not more than 80% of the maximum pressure setting.

24. The method of claim 15, wherein the predetermined pressure setting is not more than 90% of the maximum pressure setting.

25. The method of claim 15, further comprising shutting off the flow of fluid from the large volume displacement system when the predetermined pressure level has been reached.

* * * * *